US005914088A

United States Patent [19]

Rao et al.

[11] Patent Number: 5,914,088

[45] Date of Patent: Jun. 22, 1999

[54] APPARATUS FOR CONTINUOUSLY ANNEALING AMORPHOUS ALLOY CORES WITH CLOSED MAGNETIC PATH

[75] Inventors: Burrasheshagiri Rao; Dasari Jai Ramesh, both of Andhra Pradesh, India

[73] Assignee: Vijai Electricals Limited, Andhra Pradesh, India

[21] Appl. No.: 08/916,019

[22] Filed: Aug. 21, 1997

[51] Int. Cl.[6] ..... C21D 11/00

[52] U.S. Cl. ..... 266/87; 266/252; 266/255

[58] Field of Search ..... 266/252, 255, 266/249, 257, 87; 219/390

[56] References Cited

U.S. PATENT DOCUMENTS 2,175,922 10/1939 Scott ..... 266/255

2,768,277 10/1956 Buck et al. ..... 266/255

4,238,122 12/1980 Snyder et al. ..... 266/252

*Primary Examiner*—Scott Kastler

*Attorney, Agent, or Firm*—Ladas & Parry

[57] ABSTRACT

An apparatus for continuously annealing amorphous metal alloy cores with a closed magnetic path consists of a tunnel furnace having a bus bar connected sequentially to a DC power source. Switching is provided to simultaneously close and open electrical contacts provided on either end of the bus bar to ensure a continuous supply of power while loading or unloading jobs. The apparatus has a conveyer and loading and unloading mechanisms at the feeder end and discharge end of the furnace. The bus bar passes through the core window of the amorphous metal alloy core during the annealing process. The apparatus also consists of conventional trip mechanisms, heating and cooling mechanisms and mechanisms for gas flow through the furnace.

10 Claims, 9 Drawing Sheets

TOP VIEW OF TUNNEL FURNACE

TOP VIEW OF TUNNEL FURNACE

SIDE VIEW OF TUNNEL FURNACE

CROSS SECTION OF HEATING ZONE

CROSS SECTION OF COOLING ZONE

SWITCHING SCHEMATIC DIAGRAM

D.C. SOURCE

SWITCHING LOGIC

APPARATUS FOR CONTINUOUSLY ANNEALING AMORPHOUS ALLOY CORES WITH CLOSED MAGNETIC PATH

This invention relates to an apparatus for continuously annealing amorphous alloy cores with a closed magnetic path.

In India about 23% of the generated electrical energy is lost during transmission and distribution which is very high when compared to the 8 to 10% energy losses in other countries. Efforts have been made to reduce these losses to conserve the existing energy generation. Distribution transformers contribute to a considerable amount of energy loss, as these losses are present even when the transformers are under no load conditions. This is particularly important in rural areas where load factors are very low.

The use of amorphous alloy steel, in place of cold rolled grain oriented silicon steel, commercially known as CRGO, for transformer cores reduces no-load losses or core losses of transformers by approximately 75%. If all the existing distribution transformers of the Indian power system are replaced by amorphous core transformers, the annual savings in energy cost would be around Rs.337 cores or, words, energy conserved will be equal an increase in generation capacity by at least 370 MW. Though replacement of the existing transformer cores is not practicable, new distribution transformers with amorphous alloy cores may be installed resulting in substantial energy savings.

The word "amorphous metal" used herein means a metal lacking in symmetrical structure or form. Amorphous metals are a group of alloys with metallic properties, but without the crystalline lattice of conventional metals. They have no atomic order and are amorphous like frozen in-met or glass. Consequently, they are known as metallic glasses.

Transformers having amorphous magnetic metallic cores, are known in the art. The manufacturing processes of such transformers are different from conventional CRGO steel core transformers. Amorphous magnetic materials are hard and can be obtained as very thin sheets. These materials require magnetic fields while annealing and they become less ductile after such annealing.

Core manufacturing with amorphous magnetic metal comprises the steps of (a) core winding; (b) core cutting; (c) core forming; and (d) magnetic field annealing. The annealing step optimises the core losses.

Amorphous metal glasses do not posses any magentocrystalline anisotropy because of their random atomic architecture. However, magnetic anisotrophy (i.e. the measure of the use of magnetization away from a given direction) can be induced in metallic glasses. Amorphous core material in a cast state has a huge quenching stress resulting from the rapid cooling rate during its manufacture. These stresses lead to a distribution of stress induced magnetic anisotrophy resulting in a complex domain structure. Annealing of the core is done to relieve this quenching stress and also to induce a preferred axis of magnetostriction along the ribbon length. Annealing is carried out at temperatures which will preserve the glassy nature of the material. A magnetic field of sufficient strength, approximately 10 oersted, is applied to magnetically saturate the material at the annealing temperature. Annealing is carried out in an inert atmosphere in a temperature range of 300° C.–500° C.

Currently batch annealing process is used for the purpose of annealing amorphous core material. In this process, the individual core loops required to be annealed are put in a closed furnace with an arrangement of busbar passing through all the core windows, through which the magnetization current is passed. This magnetization current is required to flow through the entire cycle of annealing. On the completion of the cycle the busbar arrangement is dismantled before the annealed cores can be removed. This process of loading the fresh cores and assembling the busbar will have to be repeated before the fresh cycle of annealing can start. Thus one batch of cores at a time only can be annealed.

The requirement of loading of cores, assembling and dismantling of the busbar system entails a lot of time. Besides, all the metal parts of the furnace are required to be cooled to ambient temperature before the above assembling of the busbar can be undertaken. Thus, a lot of time is wasted between the batches. Consequently, the rate of production suffers. Electrical energy is also required to be spent to cool the furnace to the room temperature and again to heat it for the next cycle. Thus this process involves wasting electrical energy.

This invention relates to the development of a process to over come the above-cited disadvantages of the batch annealing process. The concept is one of continuously annealing under uninterrupted magnetization conditions.

In this process the cores are continuously loaded at one end of a tunnel furnace and unloaded at the other end at a rate determined by the heating cycle. A single busbar, to conduct magnetization current, is arranged to run along the length of the tunnel furnace and an arrangement to transport the cores through the furnace is also made such that the busbar passes through the windows of all the cores to achieve the goal of uninterrupted magnetization current between loading and unloading points provided on both ends of the furnace. Two sets each of electrical contacts operated by hydraulic cylinders are arranged at these points. These contacts permit the passage of current through the busbar even while loading and unloading, so that the magnetization current is continuously available for the jobs which are in the furnace. Since the annealing process is continuous the temperature in the zones of the furnace are only required to be maintained at their levels, thus saving the energy spent in a batch furnace for cooling and heating between the batches. The continuous process also eliminates the time wasted between the batches in a batch furnace, thus increasing the rate of production.

The object of the invention is to provide continuous magnetization current to cores during the process of annealing and also to make feasible the loading and the unloading of the cores without interrupting the magnetization current. It is achieved by providing an alternative path for magnetization current to the busbar while loading and unloading during the process. To accomplish this, two pairs of electrical contacts are provided on either end of the furnace. These are operated hydraulically and controlled electrically through a suitable interlocking sequential logic in order to ensure continuous magnetizing current.

DESCRIPTION OF THE ACCOMPANYING DRAWINGS

Figure 1:
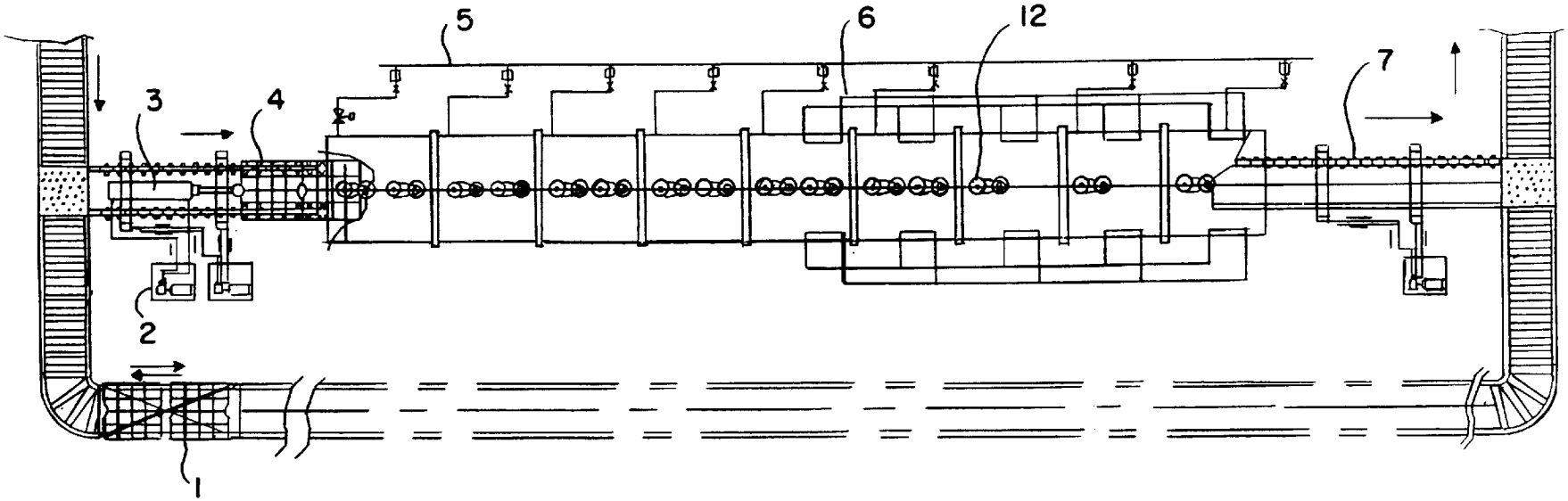
FIG. 1 shows the plan view of the apparatus for continuously anealing amorphous alloy cores with a closed magnetic path according to the invention.
Figure 2:
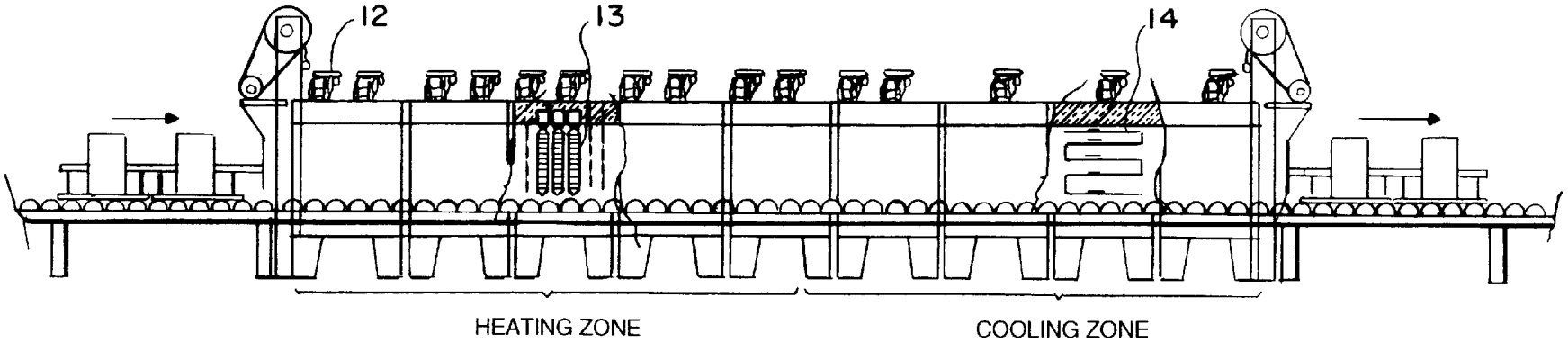
FIG. 2 shows the side view of the apparatus.
Figure 3:
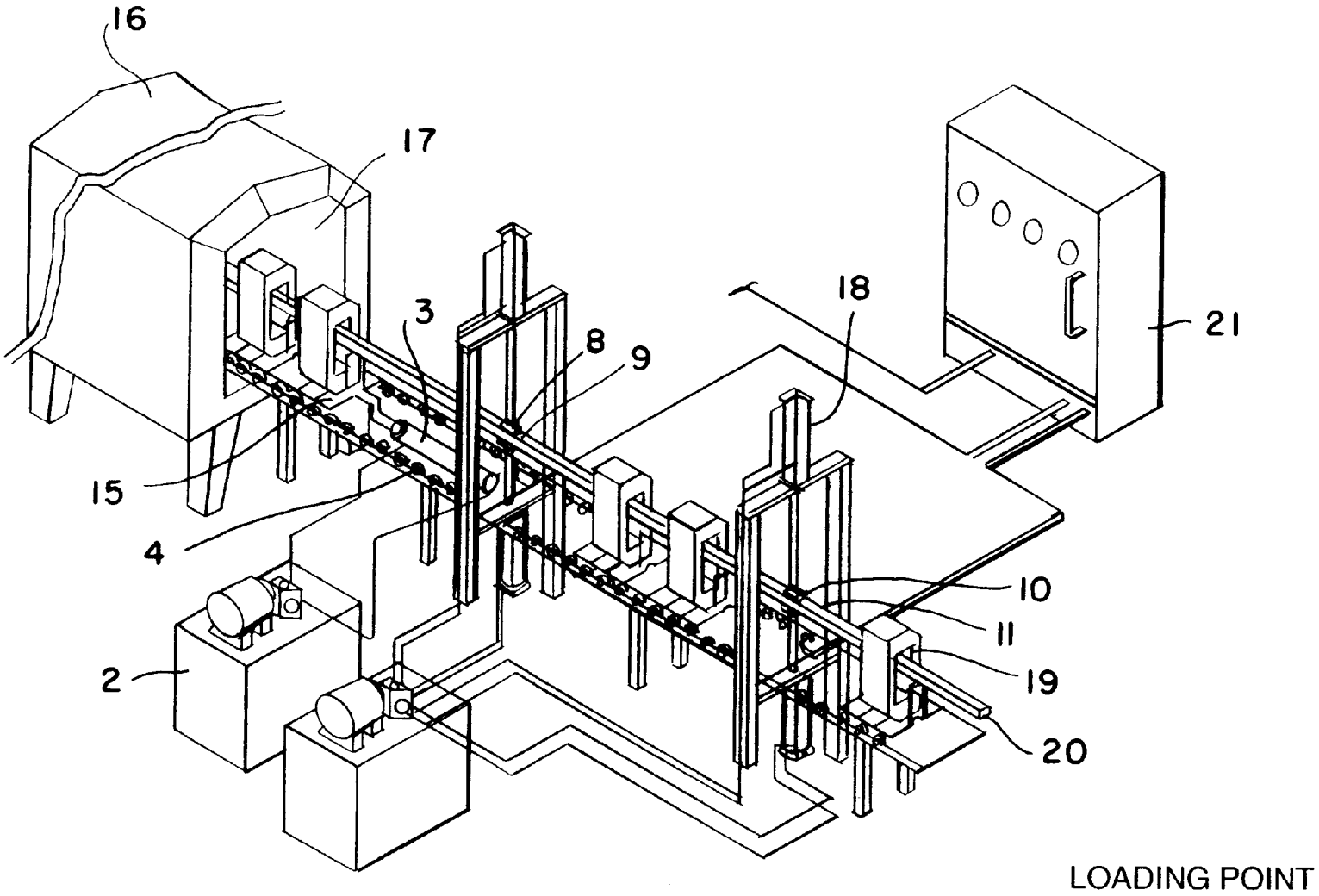
FIG. 3 shows the arrangement at the loading end of the tunnel furnace with the contractors which enable uninterrupted direct current through the busbar.
Figure 4:
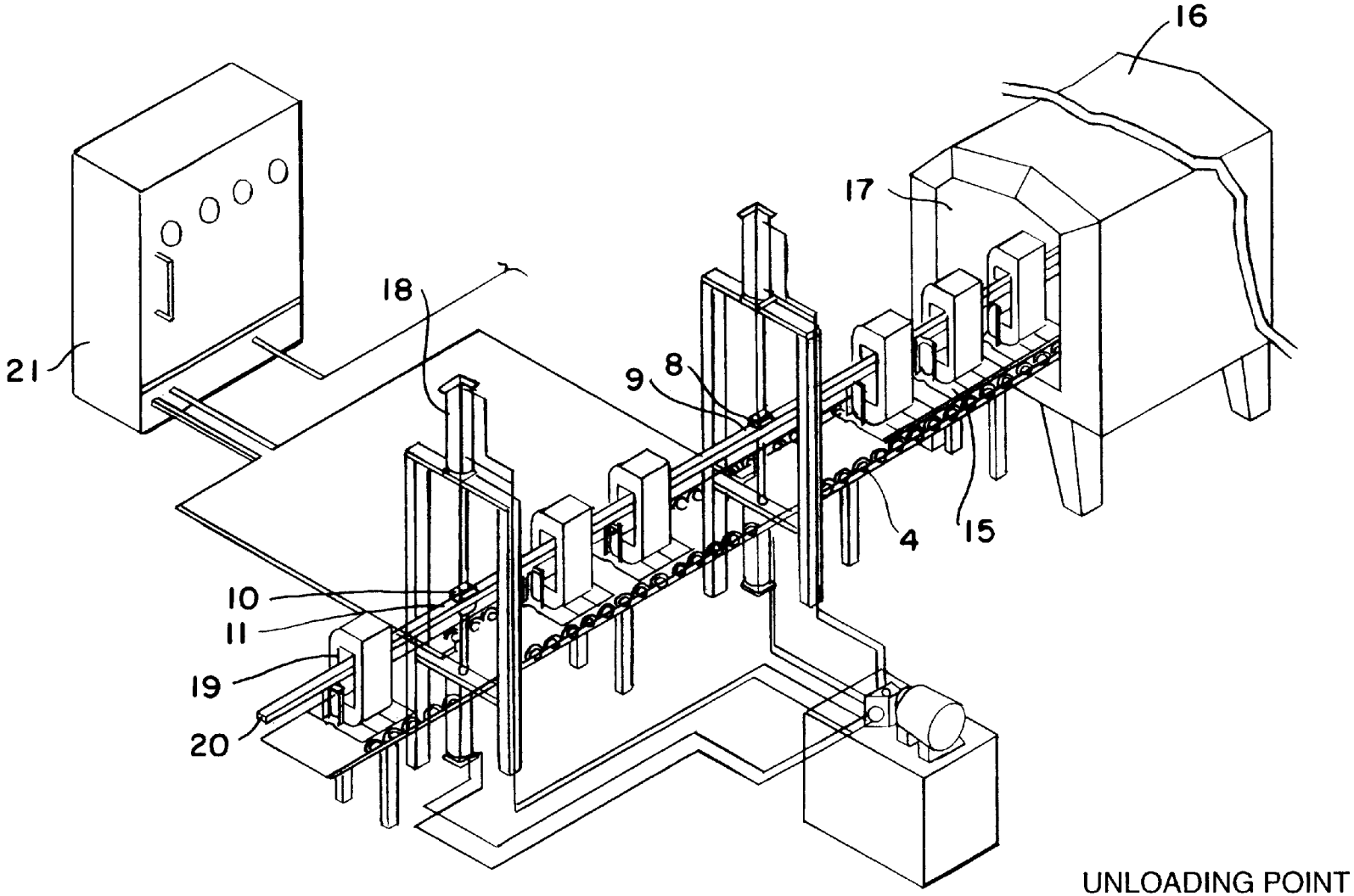
FIG. 4 shows the arrangement at the unloading end of the tunnel furnace with the contractors which enable interrupted direct current through the busbar.
Figure 5:
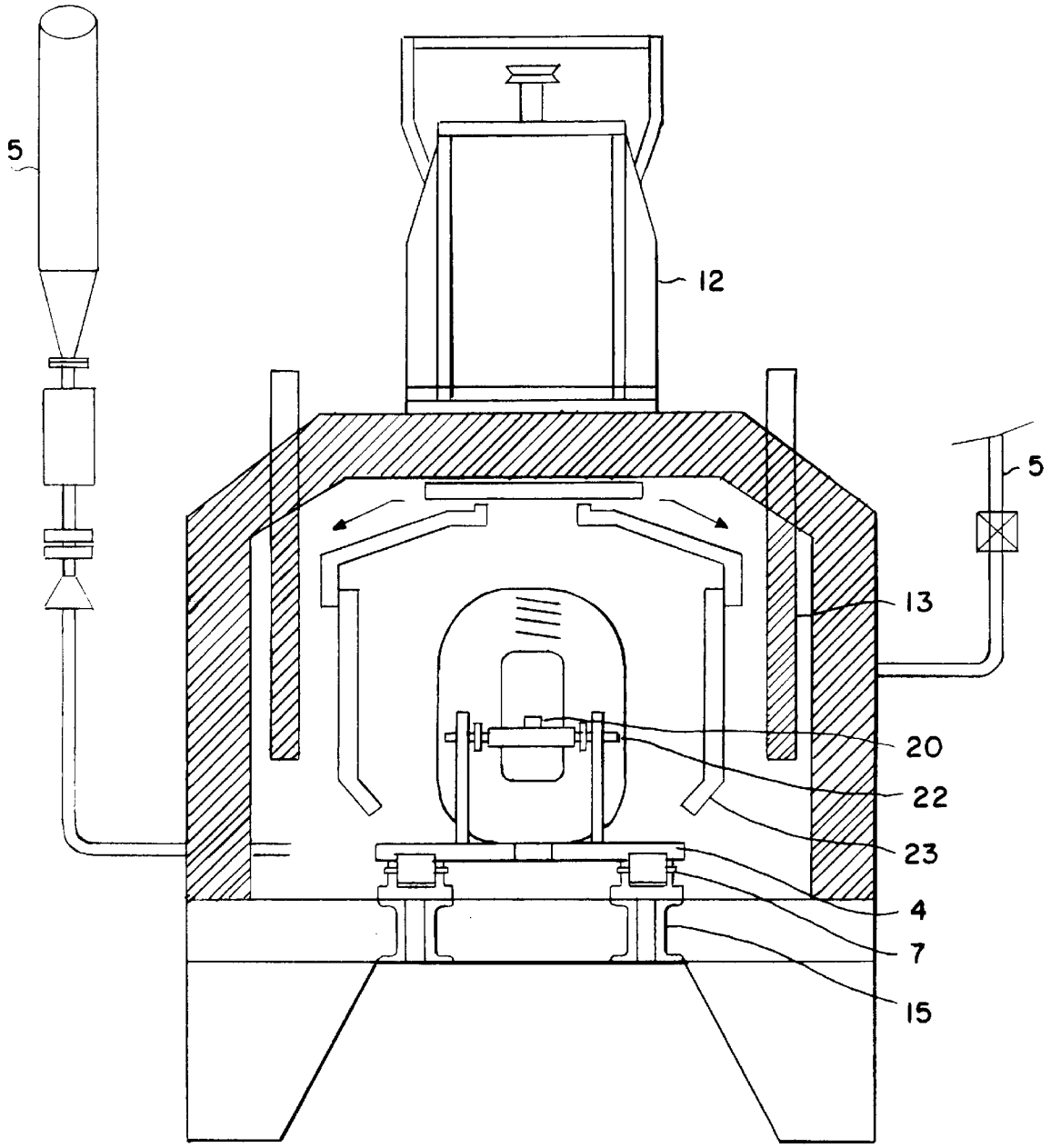
FIG. 5 shows the cross-section of the heating zone.
Figure 6:
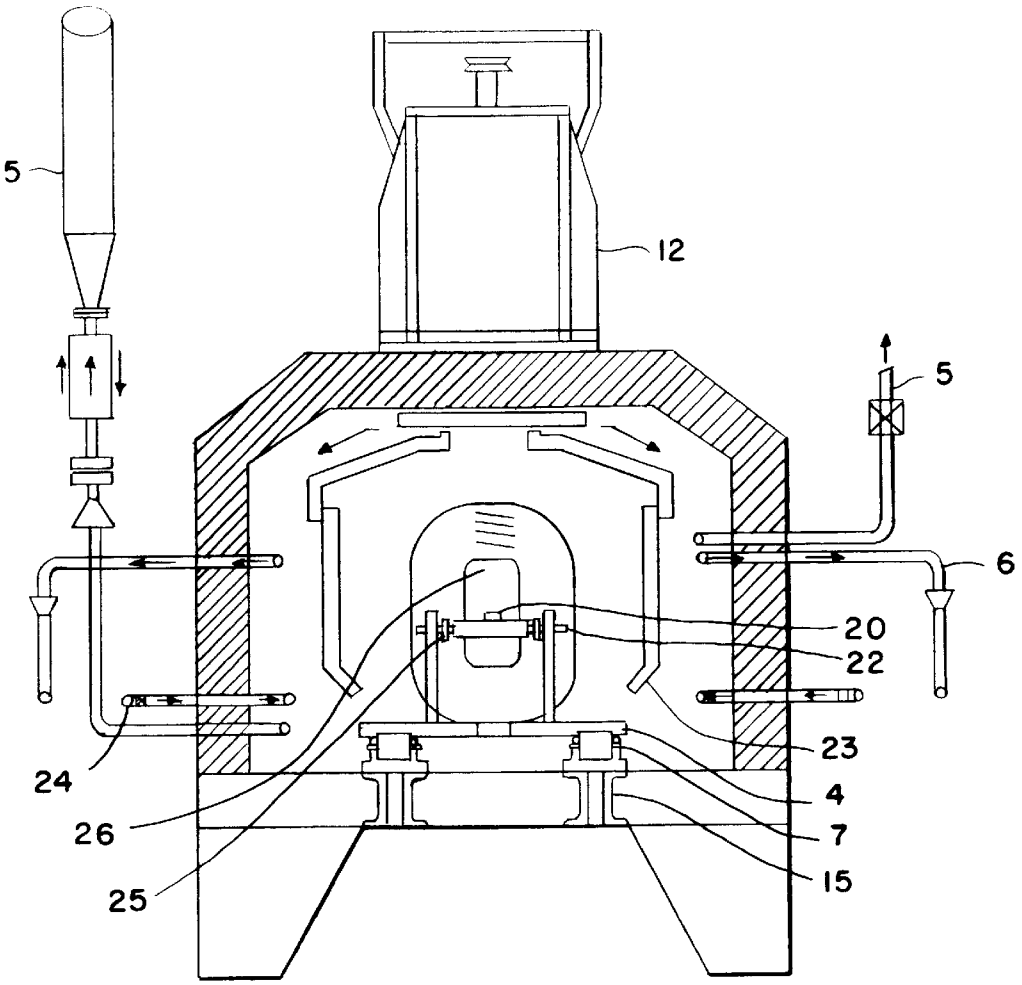
FIG. 6 shows the cross-section of the cooling zone.
Figure 7:
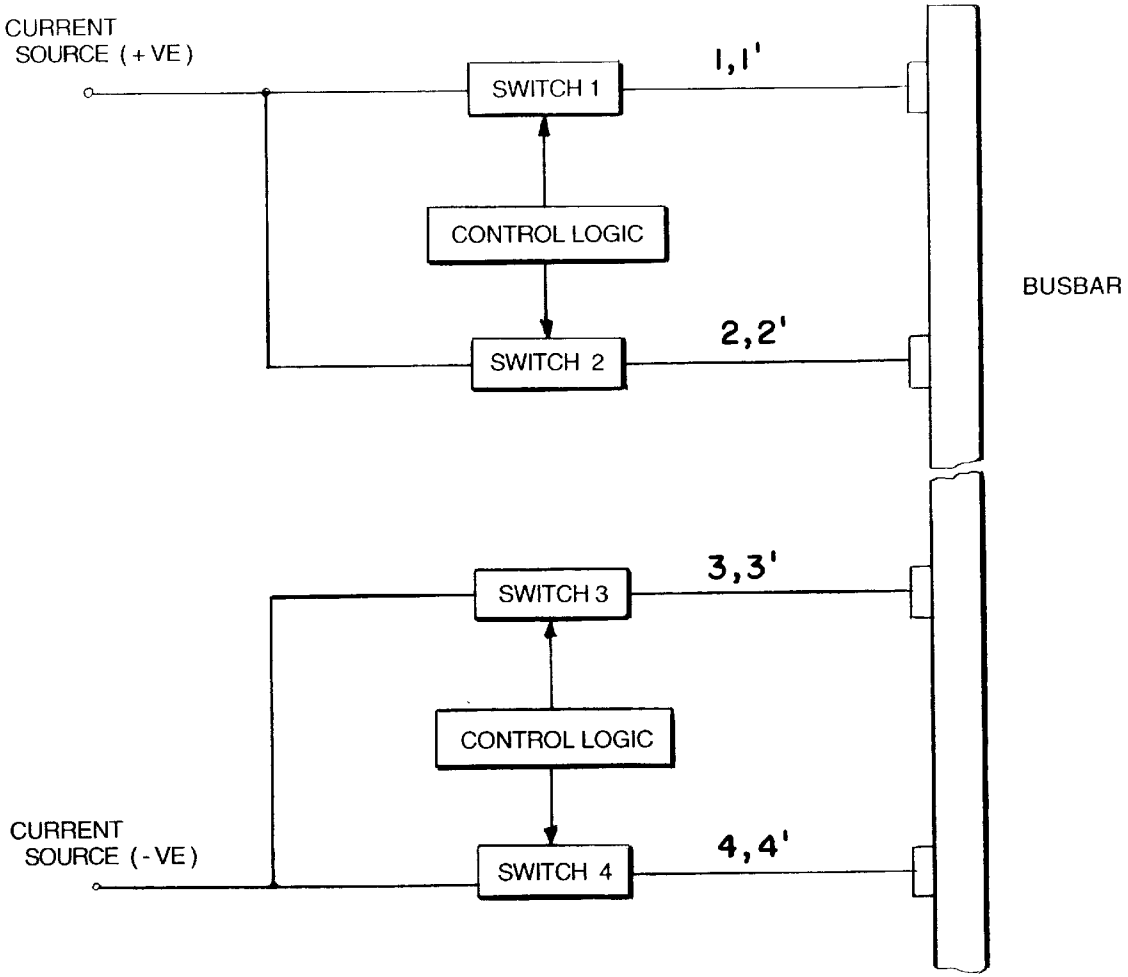
FIG. 7 shows the schematic diagram of the switching circuit.
Figure 8:
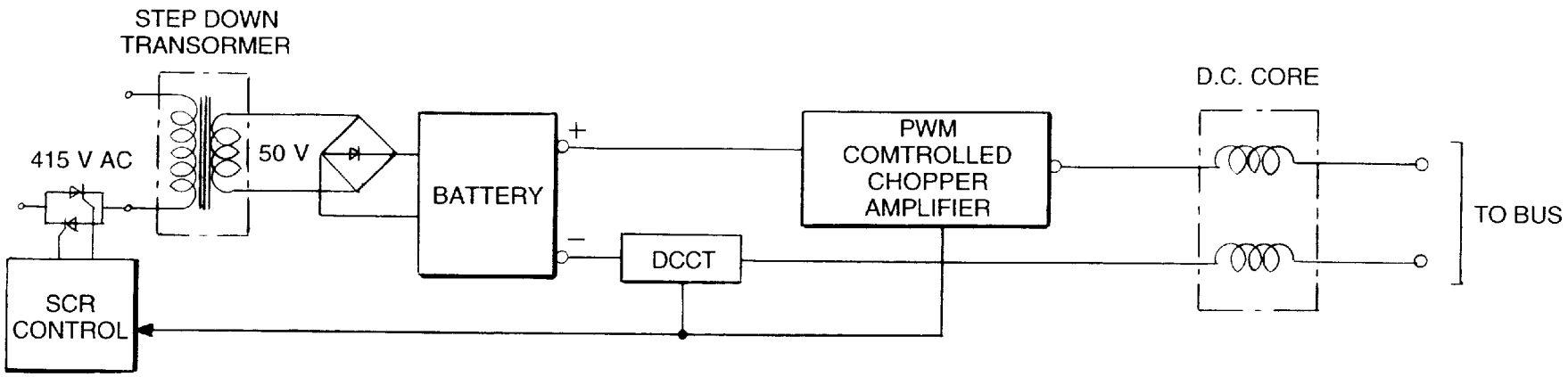
FIG. 8 shows the circuit of the D.C. source.
Figure 9:
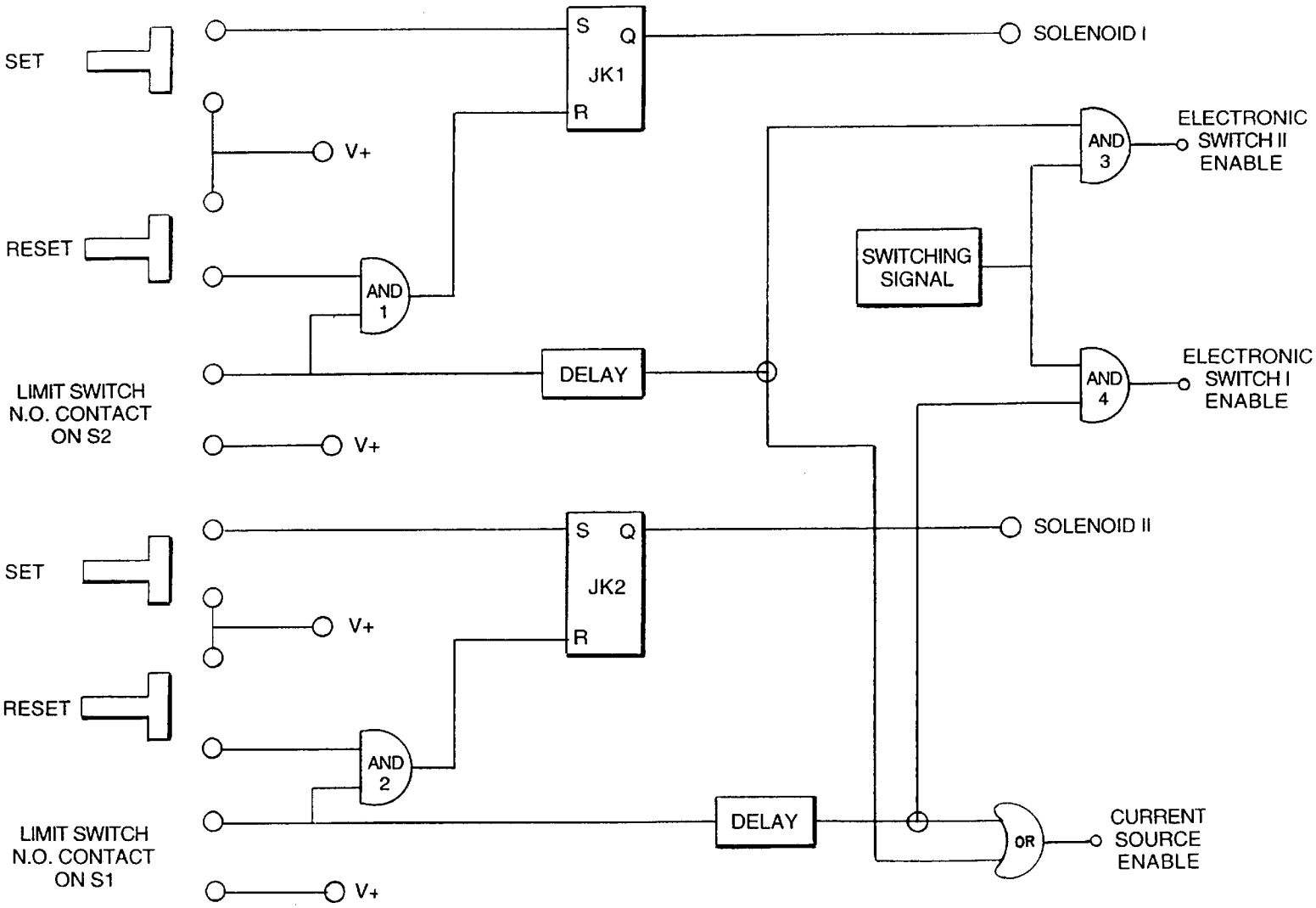
FIG. 9 shows the switching logic circuit.

The continuous annealing furnace consists of a tunnel furnace (16) of the desired length through which an inert gas, such as nitrogen, is made to flow under constant pressure to avoid oxidisation of the jobs. The inert gas is supplied from an inert gas line (5). The tunnel furnace is divided into heating and cooling zones which are designed with two layers of sheet steel with thermal insulation between them. The heating zone has a ceramic brick lining along the inner surface. Air circulating fans (12) with suitable baffle plates (23) are fitted along the length of the furnace at suitable intervals to maintain uniform temperature in the respective zones of the furnace. The heating zone is fitted with resistance heating means (13) which have thyrister controllers to maintain the temperature constant at the desired level. The cooling zone has provisions to circulate cooling water along the inner wall through copper pipes (14) having a water outlet (6), thereby cooling the zone by heat transfer. Circulating fans with suitable baffle plates (23) are also provided in the cooling zone to make the heat transfer effective.

A busbar (20) with predetermined direct current carrying capacity is provided within the furnace for magnetization current. Though any conductive metal can be used as a busbar, copper is used for obvious reasons of conductivity and economy. The square busbar is prefered for increased surface contact area, thereby minimizing contact resistance at electrical contacts. The busbar is passed through the core window (26).

The core (19) is loaded on a cast-iron trolley (4) with perforations for free air circulation while passing through the furnace (16). It is provided with two supports on either side to hold the busbar (20) with ceramic insulation (25) to avoid the grounding of the busbar (20). An endless conveyor passes through the furnace which is a cast-iron track (15), provided with idler cast-iron rollers (22) arranged at regular intervals to said cast-iron track (15). The trolley (4) carrying the core is provided with slots at the bottom for moving on these rollers. The busbar rests on the supports provided on the trolley. The core (19) is loaded on the trolley (4) such that the busbar passes through the core window (26).

A hydraulic pusher (3) is arranged at the entrance of the furnace. The pusher (3) is provided with a power pack (2). The pusher (3) pushes the entering trolley with core on it into the furnace at the loading end (17). As the furnace is provided with a track (15) on which the trolley (4) moves, the entering trolley pushes the preceding one. At the other end of the tunnel furnace, annealed cores are collected at the unloading point. The empty trolleys at the discharge end will be sent to the loading point through a mechanized return conveyer (1).

Loading and unloading means is an arrangement made on either side of the furnace to load the fresh jobs at the charging end and to remove annealed cores at the discharge end without interruption of the magnetizing current through the jobs in the furnace which would be at different stages of annealing. To accomplish this, two pairs of electrical contractors (8, 9; 10, 11) are provided on either end. These are hydrualically operated by hydraulic cylinders (18) and their solenoid valves are controlled electrically by the interlocking sequential logic, to ensure a continuous magnetizing current through the jobs. Electronic switches, S1, S2, S3, and S4, employing Insulated Gate Bi-polar Transistors (IGBTs) are used to steer magnetizing current through hydraulic cylinder operated electrical contacts 1, 1', 2, 2', 3, 3' and 4, 4'. During the operation, the switch contacts 1, 1' can be opened by the control logic while the switch contacts 2, 2' remain in contact with the busbar to connect a direct current source to it. When the cores are fed by the conveyer, they pass through the open contacts (1, 1'). In the next sequence, contacts (1, 1') are closed to maintain the connection of the DC power supply to the bus bar while contacts (2, 2') are open for the cores to pass through into the furnace. A continuous annealing operation with uninterrupted magnetization current is thus ensured while loading jobs. Similarly, the control logic operates the switching contacts 3, 3' and 4, 4' sequentially, one at a time, to facilitate unloading of jobs at the discharge end, without interrupting the magnitizing current through the jobs in the furnace.

Various functions of furnace operation during the process of annealing are controlled by a programmable logic controller (PLC). The various functions controlled are temperature control of the heating zone, rotation of air circulating fans, water circulation through the cooling zone, inert gas circulation, and the transport mechanism of the cores. This PLC is exclusively used to maintain the required operating conditions.

The DC source connected through the DC pannel (21) is a constant current source whose output can be pre-set to the desised level in the range of 300–1500 Amps. The source employs IGBTs, operating as a chopper amplifier using a pulse width modulation (PWM) technique with current feedback to maintain the output current constant at the set level. Normally, the current is drawn from a battery of suitable ampere-hour rating which is maintained on float charge by a thyrister controlled charger. Keeping in mind the magnitude of the current, the system is required to provide adequate safety measures which are incorporated. All the power handling devices such as the rectfier stack, the busbar, the switching devices (IGBTs) and the DC choke are all water cooled, employing a heat exchanger. The inner water circuit utilizes distilled and demineralised water and the outer circuit utilizes raw water. In each of the water lines, water flow rate monitoring switches are employed which operate when the flow rate falls below a critical level of 2 gallons per minute. These switch contacts are wired into the sequential switching logic to provide audio-visual alarm indication to the operator to ensure immediate remedial measures.

The control system of the DC source uses the pulse width modulation (PWM) technique to maintain the output current constant at the set level. The present reference signal is compared to the current feedback signal. The error signal thus generated controls the width of the PWM signal pulse fed to the gate of the chopper amplifier IGBT. If the output current is lower, the pulse is widened and narrowed for an increased level of operated current. The output current, which is a rectangular wave is smoothed by the DC choke which is wound in two sections, one in the outgoing line and the other in the return path.

The control logic ensures sequential operation of the electronic switches S1, S2, S3 and the electrical contacts 1, 1', 2, 2', 3, 3' and 4, 4', such that an uninterrupted current path is maintained through the bus bar. Electrical contacts operated by hydraulic cylinders, which are in turn operated by solenoid valves are interlocked such that an IGBT based electronic switch is enabled only after its relevant electrical contact is closed. Similarly, at least one of the sets of electrical contacts along with its relevant electronic switch is always on at either end and one opens only after the other is ensured to be in a closed condition.

Two J K Flip Flops (JK1 and JK2) are employed for the solenoid operated hydraulic cylinders (18). These can be SET and RESET individually by the operator. AND1 ensures that the solenoid I can be RESET only after the limit switch of the second solenoid is closed, ensuring one of the two paths for the current is available. Similarly, AND2 ensures that solenoid II can only be turned off after the limit switch of solenoid I is closed. AND3 ensures enabling of electronic switch S2 only when solenoid II closes electrical contacts 2, 2' and AND4 enables S1 only when solenoid I closes electrical contacts 1, 1'. The output of the OR gate enables current source output only when either or both of the switches are ON, ensuring a current path. An identical arrangement is duplicated at the other end of the furnace to switch electrical contacts 3, 3' and 4, 4' and electronic switches S3 & S4. Provision is made to connect a dimmerstat in the primary of the mains transformer for operating as a standby in the event of failure of the SCR regulator. In the event of power failure the battery continues to feed the current to save the batch of cores under process. The battery is capable of providing a back up for about 30 min. before which time either the mains power supply is restored or a generator is started. In order to ensure this, the system is preferably provided with a DC current trip which senses the line input current and means for automatic change over the standby source in the event of power failure. The DC power supply source is provided with a main switch to isolate mains power from the equipment at the time of repairs. Provisions are also made for changing over to dimmerstat control in the event of thyrister block failure to save the batch under processing.

Description of Parts Corresponding to Reference Numerals

SL. NO. DESCRIPTION
1. RETURN CONVEYOR
2. HYDRAULIC PUSHER POWER PACK
3. HYDRAULIC PUSHER
4. TROLLEY
5. INERT GAS LINE
6. WATER OUTLET
7. ROLLERS
8. ELECTRICAL CONTACTOR
9. ELECTRICAL CONTACTOR
10. ELECTRICAL CONTACTOR
11. ELECTRICAL CONTACTOR
12. AIR CIRCULATING FANS
13. HEATERS
14. COPPER PIPES
15. TRACK
16. TUNNEL FURNACE
17. LOADING END
18. HYDRAULIC CYLINDERS FOR ELECTRICAL CONTACTOR
19. CORE
20. BUS BAR
21. DC PANNEL
22. SUPPORTING ROLLERS WITH CERAMIC INSULATION
23. BAFFLE PLATE
24. WATER INLET ARRANGEMENT
25. CERAMIC INSULATION
26. CORE WINDOW

We claim:

1. An apparatus for continuously annealing amorphous metal alloy cores with closed magnetic path comprising a tunnel furnace having a heating zone and a cooling zone, said furnace being provided with a DC bus bar passing therethrough and extending beyond the furnace on either side thereof; conveyor means for conveying said amorphous metal alloy cores into the said furnace continuously, the center portion of said cores encasing the DC bus bar; at least two pairs of electrical contact means, on each end of said bus bar connected to a DC power source through sequence switching means having control means for sequentially opening and closing said electrical contact means to ensure continuous current flow through said DC bus bar, loading means for loading the cores to conveying means at the feeding end and unloading means for discharging the annealed amosphous metal alloy cores at a delivery end of the said tunnel furnace.

2. The apparatus as claimed in claim 1, wherein the tunnel furnace has circulating means for circulating inert gas therethrough.

3. The apparatus as claimed in claim 1, wherein the heating zone of the tunnel furnace is provided with thyristor control means for regulating the temperature.

4. The apparatus as claimed in claim 1, wherein the cooling zone of the tunnel furnace is provided with water circulating means for cooling.

5. The apparatus as claimed in claim 4, wherein coolant failure indicating means to indicate failure of coolant water flow is provided.

6. The apparatus as claimed in claim 1, wherein an excessive temperature tripping means is provided to the furnace.

7. The apparatus as claimed in claim 6, wherein the excessive temperature tripping means is a silicon controlled rectifier switching circuit.

8. The apparatus as claimed in claim 1, wherein sensing means to sense and operate DC current trip is provided.

9. The apparatus as claimed in claim 1, wherein pulse width modulation control power supply means is provided which is actuated in the event of a power failure.

10. The apparatus as claimed in claim 1, wherein a dimmerstat control means is provided to the heating zone of the furnace as temperature controller.

* * * * *